US008745904B2

(12) United States Patent
Paccaud

(10) Patent No.: US 8,745,904 B2
(45) Date of Patent: Jun. 10, 2014

(54) HEATING APPLIANCE COVERED WITH A SELF-CLEANING COATING AND PRODUCTION METHOD THEREOF

(75) Inventor: Denis Paccaud, Lyons (FR)

(73) Assignee: SEB S.A. (FR)

( * ) Notice: Subject to any disclaimer, the term of this patent is extended or adjusted under 35 U.S.C. 154(b) by 0 days.

(21) Appl. No.: 13/989,924

(22) PCT Filed: Nov. 29, 2011

(86) PCT No.: PCT/FR2011/052809

§ 371 (c)(1), (2), (4) Date: May 28, 2013

(87) PCT Pub. No.: WO2012/072944

PCT Pub. Date: Jun. 7, 2012

(65) Prior Publication Data

US 2013/0247430 A1 Sep. 26, 2013

(30) Foreign Application Priority Data

Nov. 29, 2010 (FR) ..... 10 59868

(51) Int. Cl.
*D06F 75/38* (2006.01)
*D06F 75/14* (2006.01)

(52) U.S. Cl.
USPC ..... 38/93

(58) Field of Classification Search
USPC ..... 38/74–77.9, 80, 81, 88, 93, 97; 219/245, 543; 423/651; 427/97.1, 97.8, 427/98.1, 98.3, 446, 455
See application file for complete search history.

(56) References Cited

U.S. PATENT DOCUMENTS

| | | | | |
|---|---|---|---|---|
| 3,566,855 | A * | 3/1971 | Morgan | 126/19 R |
| 3,738,350 | A * | 6/1973 | Stiles | 126/19 R |
| 5,411,771 | A * | 5/1995 | Tsai | 427/456 |
| 6,126,989 | A * | 10/2000 | Robinson et al. | 427/97.2 |
| 6,245,390 | B1 * | 6/2001 | Baranovski et al. | 427/449 |
| 7,040,047 | B2 * | 5/2006 | Boulud et al. | 38/93 |
| 7,339,142 | B2 * | 3/2008 | Pessayre et al. | 219/543 |
| 7,524,531 | B2 * | 4/2009 | Axtell et al. | 427/226 |
| 2005/0265920 | A1 * | 12/2005 | Ercan et al. | 423/651 |
| 2006/0231387 | A1 * | 10/2006 | Houda et al. | 204/280 |
| 2007/0116870 | A1 * | 5/2007 | Dettling et al. | 427/230 |
| 2013/0045858 | A1 * | 2/2013 | Mohajeri | 502/5 |
| 2014/0045677 | A1 * | 2/2014 | Carlson et al. | 502/1 |

* cited by examiner

*Primary Examiner* — Ismael Izaguirre
(74) *Attorney, Agent, or Firm* — The Webb Law Firm

(57) ABSTRACT

A heating appliance including a metal substrate, at least a part of which is covered with a self-cleaning coating including at least one oxidation catalyst selected from the platinoid oxides, and at least one dopant of said oxidation catalyst selected from the rare-earth oxides. The self-cleaning coating is a bilayer coating including: an inner layer at least partially covering the metal substrate and including the dopant; and an outer layer in contact with the ambient air and including the oxidation catalyst. Also provided is a method for producing such a heating appliance.

14 Claims, 2 Drawing Sheets

HEATING APPLIANCE COVERED WITH A SELF-CLEANING COATING AND PRODUCTION METHOD THEREOF

BACKGROUND OF THE INVENTION

1. Field of the Invention

The present invention relates generally to heating appliances or appliances intended to be heated during the use thereof and comprising a self-cleaning coating.

2. Description of Related Art

The term "heating appliance" is understood to mean, within the meaning of the present patent application, any appliance, article or utensil, which, during the functioning thereof, reaches a temperature at least equal to 65° C. (which is the minimum reheating temperature) and preferably at least equal to 90° C. The appliance can reach this operating temperature by means which are specific to it, such as, for example, a heating base incorporated in the appliance and equipped with heating elements, or by external means. It concerns in particular sole plates of irons, cooking appliances, ovens, grills and cooking utensils. Among these heating appliances, some, such as sole plates of irons or cooking appliances, exhibit qualities of ease of use and effectiveness which depend, inter alia, on the state and the nature of the surface of the coating thereof. As regards sole plates of irons, the latter have been able to be improved by virtue of the care contributed to the glide qualities of the ironing surface, in combination with those which make possible easier spreading of the laundry. One way of obtaining these qualities is to resort to sole plates enameled with an enamel having a smooth appearance, optionally with lines of excessive thickness for promoting the spreading of the fabric during the movement of the iron. It is also known to use metal sole plates which are treated mechanically and/or which are or are not covered with a deposit for facilitating the gliding.

However, with use, the sole plate can become tarnished by carbonizing in a more or less diffuse fashion over its ironing surface, and, in a more or less incomplete fashion, various contaminants of organic origin (in particular in a particulate form) which are captured by the sole plate by rubbing over the ironed fabrics. The tarnishing of the sole plate, even in a not very visible way, results in an at least partial loss of its glide qualities. In addition, with the fouling, ironing becomes more difficult. Finally, the user dreads using a tarnished iron, fearing that it may detrimentally affect her laundry.

Iron sole plate coatings, comprising a hard and resistant layer covered by a layer which improves the surface properties, are known, such as taught by the U.S. Pat. No. 4,862,609. However, this patent does not indicate a solution for combating fouling.

This problem of fouling may also be encountered for other types of heating appliances, such as, for example, the walls of cooking appliances. It is known to cover them with an enameled layer having a smooth appearance, in order to prevent possible spat fat or food from adhering to the surface of these walls. In particular, enameled self-cleaning surfaces, which may in particular be encountered in ovens and cooking utensils, are known, such as taught, for example, by U.S. Pat. No. 4,029,603 or French patent FR 2 400 876. However, these surfaces are not entirely satisfactory as regards their self-cleaning properties.

In order to improve these properties, the Applicant Company has previously developed a self-cleaning coating intended to coat a metal surface of a heating appliance which is more effective in terms of catalytic activity. This coating forms the subject matter of the French patent FR 2 848 290, which describes a heating appliance comprising a metal support, at least a portion of which is covered with a self-cleaning coating, which comprises an external layer in contact with the ambient air and comprising at least one oxidation catalyst chosen from platinum group metal oxides, and at least one internal layer, located between the metal support and the external layer, comprising at least one oxidation catalyst chosen from oxides of the transition elements of Group Ib. However, this self-cleaning coating exhibits the disadvantage of requiring a large amount of platinum group metal oxides in the external layer in order to achieve correctly satisfactory levels of catalytic activity, the consequence of which is in particular a significant increase in the coating cost and thus, in the end, in that of the heating appliance.

SUMMARY OF THE INVENTION

There thus exists the need for a coating for a heating appliance, such as a cooking appliance or an iron sole plate, in which the amount of platinum group metal oxides is appreciably lower but which is more effective in terms of catalytic activity (that is to say, a coating which makes it possible to keep the covered surface clean from any contamination by organic particles and which does not become fouled in normal use), this being the case without a deterioration in the other properties required (shiny appearance, gliding and resistance to abrasion of the coating).

The term "catalytic activity of a coating" is understood to mean, within the meaning of the present invention, the ability of the external surface of this self-cleaning coating, in contact with the ambient air and with contaminants of organic origin, to incinerate these contaminants, which, once incinerated, lose any adhesion and become detached from the coating.

The term "contaminants of organic origin" is understood to mean, within the meaning of the present patent application, any substance which is combustible or which can oxidize on contact with the ambient air, completely or partially. Mention may be made, by way of example, of any residue of synthetic fibers, such as used in textile articles, for example made of organic polymer, such as polyamide or polyester, any organic residue of washing product and optionally of softening product, or any organic substance, such as spat fats or foods.

More particularly, a subject matter of the present invention is a heating appliance comprising a metal support, at least a portion of which is covered with a self-cleaning coating in contact with the ambient air and comprising at least one oxidation catalyst chosen from platinum group metal oxides, characterized in that said coating additionally comprises at least one dopant for said oxidation catalyst chosen from rare earth metal oxides.

By virtue of the heating article according to the invention, an appliance is obtained, the self-cleaning coating of which exhibits a particularly excellent catalytic activity and the adhesion of which to the metal support is very good, and which additionally makes it possible for the organic particles in contact with the self-cleaning coating to be oxidized when the appliance is heated. For example, during ironing with an iron, the organic particles captured by the sole plate are oxidized. They are, in a way, incinerated when the iron is hot and the possible solid residue loses any adhesion and becomes detached from the sole plate. The sole plate is kept clean. Likewise, in a cooking appliance, such as an oven, for example, the spat fats present on the wall of the oven are oxidized under hot conditions and the solid residue becomes detached from the wall, which is kept clean.

In addition, a synergistic effect has been found with regard to the catalytic activity when, in the self-cleaning coating, a dopant chosen from oxides of rare earth metals is combined with an oxidation catalyst chosen from platinum group metal oxides. Thus, in the present patent application, the catalytic activity of the self-cleaning coating is from three to five times greater than that obtained with the coating of FR 2 848 290, this being the case with an amount of platinum group metal oxides from two to four times lower. Thus, the surface of the coating is regenerated more rapidly than in the coatings described in FR 2 848 290.

The term "platinum group metals" is understood to mean, within the meaning of the present patent application, the elements having properties analogous to those of platinum and in particular, in addition to platinum, ruthenium, rhodium, palladium, osmium and iridium.

In practice, the oxidation catalysts of the platinum group metal oxides type are well known per se and the processes by which they are obtained, without it being necessary to describe in detail their methods of preparation respectively.

Thus, by way of example, as regards platinum(IV) oxide as oxidation catalyst (platinum dioxide hydrate $PtO_2.H_2O$ or Adams's catalyst), its catalytically active form can be obtained by melting hexachloroplatinic acid or its ammonium salt with sodium nitrate, followed by the thermal decomposition of the platinum nitrate obtained to give platinum(IV) oxide.

Preferably, the oxidation catalyst is chosen from palladium oxides, platinum oxides and their mixtures.

The term "dopant" is understood to mean, within the meaning of the present patent application, an element which is not a catalyst per se but which has the effect of increasing and of doping the catalytic activity of said catalyst and of stabilizing the hold of the catalyst on the substrate.

In the context of the present invention, use is made, as dopant for the oxidation catalyst in the self-cleaning coating, of at least one rare earth metal oxide.

The term "rare earth metals" is understood to mean, within the meaning of the present patent application, lanthanides and yttrium having properties analogous to those of lanthanum and in particular, in addition to lanthanum, cerium and yttrium.

Preferably, the dopant is chosen from cerium oxides, yttrium oxide and their mixtures.

Of course, any oxidation catalyst and any dopant selected according to the present invention will have to remain sufficiently stable at the operating temperature of the appliance and within the limits of the working lifetime of the appliance.

According to a first advantageous embodiment of the present invention, the self-cleaning coating of the heating article according to the invention is a monolayer coating comprising at least one oxide of a platinum group metal doped by yttrium oxide.

Preferably, the self-cleaning coating of the heating article according to the invention is composed of palladium oxide doped by yttrium oxide. Such a doping makes it possible to considerably reduce the amount of palladium oxide while achieving a catalytic activity at least equivalent to that of the coating of FR 2 848 290. If the amount of palladium oxide is identical to that of the coating of FR 2 848 290, then the catalytic activity is considerably improved. The effects of the doping on the catalytic activity of the coating are shown by the results of table 1 and example 4.

According to a second particularly advantageous and preferred embodiment of the present invention, the self-cleaning coating of the heating article according to the invention is a bilayer coating comprising:

an internal layer at least partially covering the metal support and comprising said dopant, and an external layer in contact with the ambient air and comprising the oxidation catalyst.

The presence of a dopant of rare earth metal oxide type in an internal layer included between the support and the layer of the coating in contact with the ambient air and comprising the oxide of platinum group metal makes it possible to obtain an increase in the catalytic activity by virtue of the oxygen available in the rare earth metal oxide network which can diffuse into the layer of platinum group metal oxide.

In this second bilayer embodiment, the self-cleaning coating according to the invention is preferably a coating which is composed of an internal layer of cerium oxide or yttrium oxide and of an external layer of palladium oxide.

Preferably, the doping internal layer has a thickness, measured according to the RBS method described in the examples (measurement methods) of the patent application, ranging from 30 nm to 100 nm. The catalytic activity increases with the thickness of the internal layer.

The external layer of the coating preferably has a thickness, also measured according to the RBS method described in the examples (measurement methods) of the present patent application, of between 10 nm and 500 nm, preferably of between 15 nm and 60 nm. The catalytic activity increases with the thickness of the layer until a threshold effect is reached.

Whatever the embodiment of the self-cleaning coating according to the invention, the oxidation catalyst is distributed on and/or in the external layer and/or the monolayer of the self-cleaning coating, which is in continuous or noncontinuous contact with the contaminants.

The metal support of the appliance according to the invention can be based on any metal commonly employed in the field of heating appliances, such as aluminum, stainless steel or titanium. This metal support can itself be covered with a protective layer, such as, for example, a layer of enamel, before being covered with the coating of the present invention.

Thus, in a preferred embodiment of the invention, the appliance comprises an intermediate protective layer made of enamel located between the metal support and the self-cleaning coating, or its internal layer according to whether the self-cleaning coating is bilayer respectively, said intermediate protective layer being composed of a material chosen from aluminum alloys, enamel and their mixtures, so that said protection layer is catalytically inert as regards the oxidation.

Preferably, the intermediate protective layer is made of enamel having a low porosity and/or roughness, at the micrometric and/or nanometric scale. The enamel is, for example, a vitreous enamel. The enamel should preferably be hard, have good gliding and withstand hydrolysis by hot steam.

In a preferred embodiment of the heating appliance according to the invention, the heating appliance is in the form of an iron sole plate comprising an ironing surface and the coating covers the ironing surface.

The term "ironing surface" is understood to mean, within the meaning of the present invention, the surface in direct contact with the laundry, allowing it to be smoothed out.

In another preferred embodiment of the invention, the heating appliance is a cooking appliance comprising walls capable of coming into contact with contaminants of organic origin and the self-cleaning coating covers these walls.

In a first operating mode of the heating appliance according to the invention, the catalyst acts at the operating temperature of the appliance and the coating is kept clean as the appliance is used.

In a second operating mode of the heating appliance according to the invention, during a "self-cleaning" phase prior or subsequent to the use of the appliance, the latter is adjusted to a high temperature, equal to or greater than the highest operating temperatures, and is then left on hold for a predetermined time, during which the oxidation catalyst produces its effect.

The user can thus regularly look after her appliance, without waiting for harmful fouling.

Another subject matter of the present invention is a process for producing a heating appliance comprising a metal support, at least a portion of which is covered with a self-cleaning coating, comprising the following stages:

i. the surface of the metal support to be covered is heated to a temperature comprised between 250° C. and 400° C. in an oven or under infrared radiation;

ii. a solution of an oxidation catalyst precursor, which is chosen from salts of platinum group metals, and of a dopant precursor is sprayed over the surface of the metal support to be covered, in order to obtain a self-cleaning coating layer;

iii. the surface of the metal support covered with the self-cleaning coating layer is baked in an oven or under infrared radiation for a few minutes, typically between 400° C. and 600° C.;

said process being characterized in that it additionally comprises the doping of said self-cleaning coating layer by a dopant chosen from rare earth metal oxides.

The term "doping of the oxidation catalyst" is understood to mean, within the meaning of the present invention, an increase in the catalytic activity of the oxidation catalyst and a stabilization of the hold of the catalyst to the substrate. This is possible by virtue of the oxygen available in the network of rare earth metal oxides which can be used by the platinum group metal oxide during the catalysis of the oxidation reaction.

The term "precursor of the oxidation catalyst" is understood to mean, within the meaning of the present invention, any chemical or physicochemical form of the oxidation catalyst which is capable of resulting in the catalyst as such or of releasing it by any appropriate treatment, for example by pyrolysis.

Mention may in particular be made, as example of precursor of the oxidation catalyst which can be used in the process according to the invention, of hexachloroplatinic acid, sold by Alfa Aesar under the trade name of dihydrogen hexachloroplatinate(IV) hexahydrate, ACS, Premium, 99.95%, Pt 37.5% min.

The application to the metal support, covered or not covered with a layer of enamel, of the catalytically active layer or layers of the self-cleaning coating is preferably carried out by pyrolysis of an aerosol (technique usually denoted by the expression "thermal spray") by heating the surface to be covered and then spraying, over this hot surface, a solution containing a precursor of the oxidation catalyst.

According to a first advantageous embodiment of the process according to the invention, the doping of said self-cleaning coating layer is carried out during stage ii of the process according to the invention by addition, to the solution of oxidation catalyst precursor, of a dopant precursor chosen from rare earth metal salts, such as to form a monolayer self-cleaning coating.

According to a second advantageous embodiment of the process according to the invention, the doping of said self-cleaning coating layer is carried out between stages i and ii as follows:

i.1 a solution of a dopant precursor chosen from rare earth metal salts is sprayed over the surface of the metal support to be covered, in order to form an internal coating layer;

i.2 the surface of the metal support covered with the internal layer is again heated to a temperature comprised between 250° C. and 400° C. in an oven or under infrared radiation.

Typically, use is made, as dopant salts or oxidation catalyst salts, of chlorides or nitrates, sometimes acetates, if this is possible.

Thus, in a particularly advantageous form of implementation of this second embodiment according to the invention, the surface of the metal support to be covered is heated in an oven to between 250° C. and 400° C. A solution of the precursor of the dopant is subsequently sprayed on the surface of the metal support. On contact with the surface, the water evaporates, the precursor is decomposed and the metal oxide formed becomes attached to the support. A layer with a thickness of between 30 nm and 100 nm is thus deposited. The support thus cooled is again heated in the oven or under infrared radiation to a temperature of between 250° C. and 400° C. for a few seconds. A solution of the precursor of the oxidation catalyst chosen is subsequently sprayed over the internal layer. A layer with a thickness ranging from 15 to 60 nm is deposited. The support thus covered is subsequently rebaked in an oven or under infrared radiation at between 400° C. and 600° C. for a few minutes, for example for five minutes. A support covered with a coating, the self-cleaning properties of which are particularly good, is then obtained.

BRIEF DESCRIPTION OF THE DRAWINGS

A better understanding of the invention will be obtained on reading the examples below and the appended drawings.

DETAILED DESCRIPTION OF THE INVENTION

The identical elements represented in FIGS. 1 to 4 are identified by identical numerical references.

Figure 1:
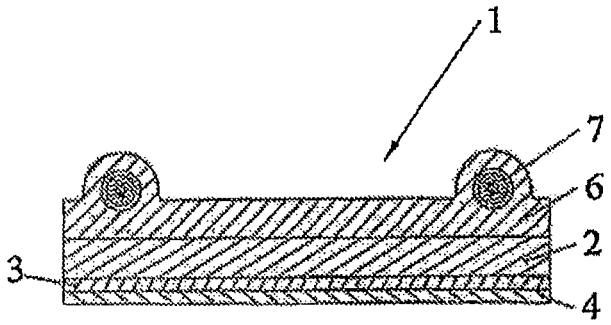
FIG. 1 is a view in cross section of a first example of iron sole plate according to the invention, comprising a bilayer self-cleaning coating on a non-enameled support.

In FIG. 1, a first example of iron sole plate 1, comprising a metal support 2 covered with an internal layer 3 and with an external layer 4, has been represented in cross section, this internal layer 3 and this external layer 4 constituting the self-cleaning coating. The sole plate also comprises a heating base 6 equipped with heating elements 7. The support 2 and the base 6 are assembled by mechanical means or by adhesive bonding. The internal layer 3 comprises a dopant chosen from rare earth metal oxides and the external layer 4 comprises an oxidation catalyst chosen from platinum group metal oxides.

Figure 2:
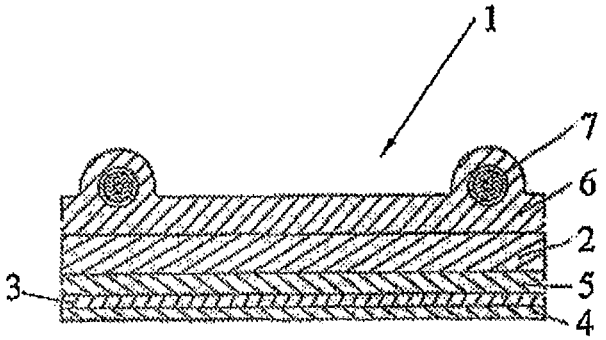
FIG. 2 is a view in cross section of a second example of iron sole plate according to the invention having a bilayer self-cleaning coating on an enameled support.

In FIG. 2, a second example of iron sole plate 1 has been represented which differs from the example represented in FIG. 1 by the presence of an intermediate protective layer 5 made of enamel which covers the support 2 and which is itself covered by the internal layer 3 of the self-cleaning coating.

Figure 3:
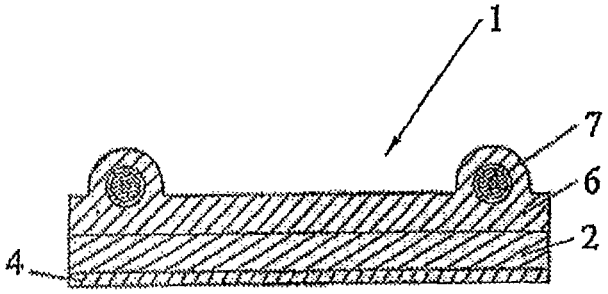
FIG. 3 is a view in cross section of a third example of iron sole plate according to the invention having a monolayer self-cleaning coating on a non-enameled support.

In FIG. 3, a third example of iron sole plate 1, comprising a metal support 2 also covered with a self-cleaning coating, has been represented in cross section. Unlike the iron examples represented in FIGS. 1 and 2, this self-cleaning coating 4 is not bilayer but monolayer. It comprises an oxidation catalyst chosen from platinum group metal oxides and a dopant chosen from rare earth metal oxides. Just as for the implementation examples represented in FIGS. 1 and 2, the sole plate also comprises a heating base 6 provided with heating elements 7, and the support 2 and the base 6 are also assembled by mechanical means or by adhesive bonding.

Figure 4:
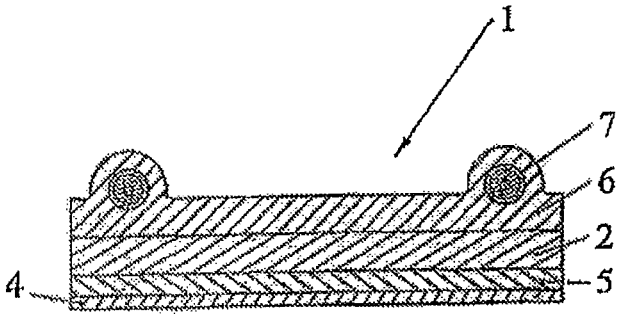
FIG. 4 is a view in cross section of a fourth example of iron sole plate according to the invention having a monolayer self-cleaning coating on an enameled support.

In FIG. 4, a fourth example of iron sole plate 1 has been represented which differs from the example represented in FIG. 3 by the presence of an intermediate protective layer 5 made of enamel which covers the support 2 and which is itself covered by the self-cleaning coating 4.

FIGS. 5 to 8 are commented on in the examples, in the section "Method of determination of the abrasion resistance".

EXAMPLES

Products

- iron sole plates, made of aluminum, enameled (comparative example 1 and examples 1 to 3) or non-enameled (comparative example 2),
- silver nitrate, sold by Aldrich,
- copper acetate, sold by VWR with the Merck brand and under the commercial name copper acetate monohydrate, Pro analysi, Assay 99.0%,
- copper nitrate, sold by VWR with the Merck brand and under the commercial name copper nitrate trihydrate, Pro analysi, Assay 99.5%,
- cerium nitrate, sold by Alfa Aesar under the trade name of cerium(III) nitrate hexahydrate, REacton, 99.99%,
- yttrium nitrate, sold by Alfa Aesar under the trade name of yttrium(III) nitrate hydrate, 99.99% (REO),
- aqueous palladium nitrate solution stabilized by nitric acid, sold by Metalor under the trade name Palladium nitrate in solution, Procatalyse grade.

Measurement Methods

RBS (Rutherford Backscattering Spectroscopy) Method

The RBS (Rutherford Backscattering Spectroscopy) method is an analytical technique based on the elastic interaction between a $^4He^{2+}$ ion beam and the component particles of the sample. The high energy (2 MeV) beam strikes the sample and the backscattered ions are detected under an angle theta. The spectrum thus acquired represents the intensity of the ions detected as a function of their energy and makes it possible to determine the thickness of the layer. This method is described in W. K. Chu and G. Langouche, MRS Bulletin, January 1993, p 32.

Method of Determination of the Catalytic Activity of the Self-Cleaning Coating

The catalytic activity of the self-cleaning coating is measured in a closed chamber as follows:

- a sample is heated to 300° C., on which is deposited a molten piece of fiber made of organic polymer weighing 10 mg, representative of the contaminants which may contaminate the external surface (which is the catalytically active surface) of the self-cleaning coating;
- the initial amount of carbon dioxide gas in the chamber is assayed; The variation in the $CO_2$ content as a function of the time makes it possible to deduce the catalytic activity of the coating;
- the efficiency of the catalytically active surface of the self-cleaning coating is defined by the amount of carbon dioxide gas produced per hour inside the chamber by a 10 $cm^2$ sample. More specifically, the slope of the curve representing the variation in the $CO_2$ content as a function of the time makes it possible to deduce the catalytic activity of the coating, as is illustrated in table 1 and example 4.

Method of Determination of the Abrasion Resistance

The principle of this method consists in sliding a pad covered with a fabric over a portion of the coating for 3000 to-and-fro movements. The fabric is made of wool and is in accordance with the standard EN ISO 12947-1.

The pad, fitted to the end of an oscillating arm and of circular shape, exhibits a contact surface area of 2.5 $cm^2$ and a weight of 1.64 kg.

The apparatus used for the test is the model sold under the trade name Taber® Linear Abrasion Tester Model 5750 by Taber Industries.

As a function of the wear of the coating observed after 3000 to-and-fro movements, a grade from 0 to 1 is assigned, in order to quantify the abrasion resistance, by observation of the wear using a stereoscopic microscope and under appropriate lighting:

- the grade 0 corresponds to an excellent abrasion resistance, for which the coated part does not exhibit any difference between the abraded surface and the remainder of the coating not subjected to the test;
- a grade between 0 and 0.5 corresponds to an abrasion resistance which can be regarded as acceptable;
- if the grade is greater than 0.5; the coatings are not regarded as suitable for the ironing function.

Figure 8:
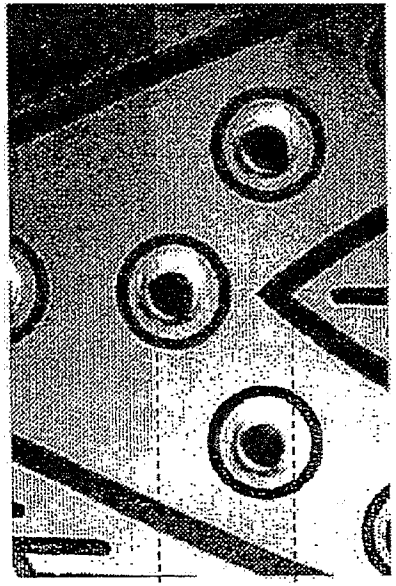
FIGS. 5 to 8 represent a succession of bottom views of iron sole plates according to the invention, enameled beforehand and then coated with a non-stick coating, which have been subjected to a test for determination of the abrasion resistance according to the standard EN ISO 12947-1; these views serve to form a visual scale for evaluation of abrasion resistance (scale described in the examples, in the section "Method of determination of the abrasion resistance").
Figure 7:
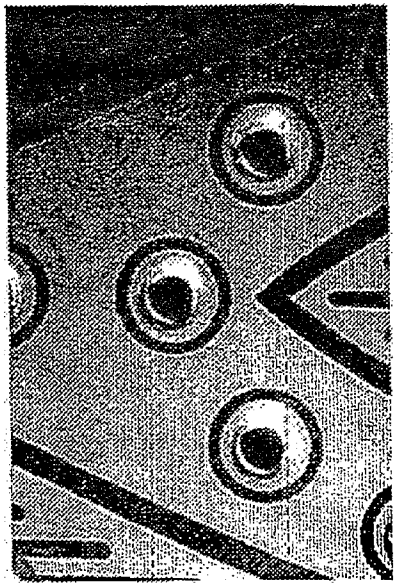
Figure 6:
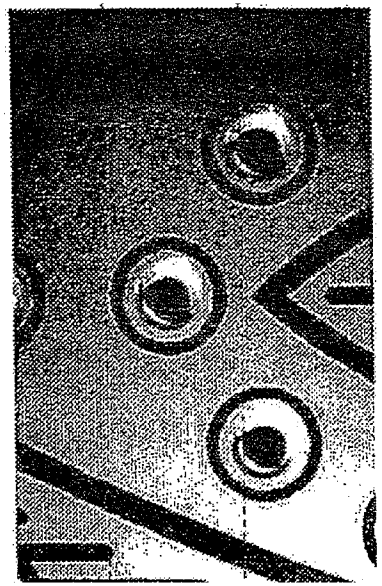
Figure 5:
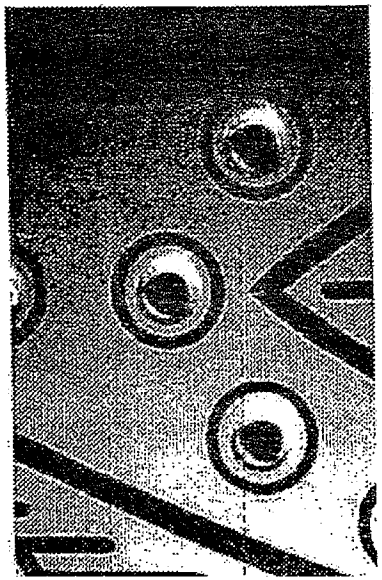

A panel of samples characterizing the different grades was set up in order to facilitate the grading, which makes it possible to produce a visual scale corresponding to the grading scale indicated above and represented in FIGS. 5 to 8:

- FIG. 5 corresponds to an abraded sole plate to which the grade 0 has been assigned; in this figure, no difference is observed between the abraded region (consisting of a band located between the two dotted lines on which the pad has slid for 3000 to-and-fro movements) and the nonabraded region; the abrasion resistance is regarded as being excellent;
- FIG. 6 corresponds to an abraded sole plate to which the grade 0.25 has been assigned; in this figure, a slight lightening of the abraded region (consisting of a band located between the two dotted lines) is observed in comparison with the nonabraded region; the abrasion resistance is regarded as being highly satisfactory;
- FIG. 7 corresponds to an abraded sole plate to which the grade 0.5 has been assigned; in this figure, a more marked lightening of the abraded region (consisting of a band located between the two dotted lines) is observed in comparison with the nonabraded region but which does not, however, result in the appearance of the underlying enamel; the abrasion resistance is regarded as being acceptable;
- FIG. 8 corresponds to an abraded sole plate to which the grade 0.75 has been assigned; in this figure, an even more marked lightening of the abraded region (consisting of a band located between the two dotted lines) is observed in comparison with the nonabraded region and which results in the appearance of the underlying enamel, the latter being visible by observation using an optical microscope or a stereoscopic microscope; the abrasion resistance is regarded as being bad and unacceptable.

Samples

For comparison purposes, the tests presented below were carried out with samples of iron sole plates which each comprise a metal support 2, enameled 5 or non-enameled, fully covered with a bilayer self-cleaning coating (comparative examples 1 and 2 and examples 1 and 2 according to the invention) or a monolayer self-cleaning coating (example 3 according to the invention).

Comparative Example 1

PdO Monolayer Coating on an Enameled Support According to the Prior Art

A clean iron sole plate made of enameled aluminum is placed on a thick support made of aluminum acting as heat reservoir in order to limit as far as possible the variations in temperature. The assembly is heated to 400° C. in an oven. The sole plate, with the support, is placed for a few seconds under infrared radiation until a surface temperature of between 400° C. and 600° C. is achieved.

An aqueous palladium nitrate solution stabilized with nitric acid is sprayed over the sole plate using an air gun. A layer with a thickness of approximately 40 to 50 nm, measured according to the RBS method described above, is then deposited.

After application, this single layer is rebaked under infrared radiation at 500° C. for three minutes.

An iron sole plate is obtained, the self-cleaning coating of which adheres to the sole plate and has a catalytic activity, while retaining its gliding qualities.

This iron sole plate corresponds to that illustrated in FIG. 4, which corresponds to an iron sole plate according to the invention with a monolayer self-cleaning coating on an enameled support. The only difference (which does not appear in this figure) is related to the absence of an oxidation catalyst in the internal layer of the self-cleaning coating, as is the case according to the present invention.

The results in terms of catalytic activity are given in table 1 and example 4.

The results in terms of abrasion resistance are given in table 2 and example 5.

Comparative Example 2

PdO/AgO Bilayer Coating on an Enameled Support According to the Prior Art FR 2 848 290

A clean iron sole plate made of enameled aluminum is placed on a thick support made of aluminum acting as heat reservoir in order to limit as far as possible the variations in temperature. The assembly is heated to 400° C. in an oven. The sole plate, with the support, is placed for a few seconds under infrared radiation until a surface temperature of between 400° C. and 600° C. is achieved.

Silver nitrate is dissolved in water. This silver nitrate solution is subsequently sprayed over the sole plate using an air gun. A layer with a thickness of approximately 40 nm to 50 nm, measured according to the RBS method, is then deposited.

After the application of this internal layer, the sole plate is again heated in the oven to 400° C. and is then placed for a few seconds under infrared radiation at a temperature of between 400° C. and 600° C.

An aqueous palladium nitrate solution stabilized with nitric acid is sprayed over the sole plate using an air gun. A layer with a thickness of approximately 40 to 50 nm, measured according to the RBS method described above, is then deposited.

After application of this external layer, the assembly is rebaked under infrared radiation at 500° C. for three minutes.

An iron sole plate is obtained, the self-cleaning coating of which adheres to the sole plate and has a catalytic activity, while retaining its gliding qualities.

This iron sole plate corresponds to that illustrated in FIG. 2, which corresponds to an iron sole plate according to the invention with a bilayer self-cleaning coating on an enameled support. The only difference (which does not appear in this figure) is related to the nature of the oxidation catalyst of the internal layer of the self-cleaning coating, which is a silver oxide in this example and not a rare earth metal oxide, as is the case according to the present invention.

The results in terms of catalytic activity are given in table 1 and example 4.

The results in terms of abrasion resistance are given in table 2 and example 5.

Comparative Example 3

PdO/CuO Bilayer Coating on an Enameled Support According to the Prior Art FR 2 848 290

A clean iron sole plate made of enameled aluminum is placed on a thick support made of aluminum acting as heat reservoir in order to limit as far as possible the variations in temperature. The assembly is heated to 300° C. in an oven. The sole plate, with the support, is placed for a few seconds under infrared radiation until a surface temperature of between 400° C. and 600° C. is achieved.

Copper acetate or copper nitrate is dissolved in water. This copper acetate or copper nitrate solution, respectively stabilized with acetic acid or nitric acid, is subsequently sprayed over the sole plate using an air gun. A layer with a thickness of approximately 40 nm to 50 nm, measured according to the RBS method, is then deposited.

After the application of this internal layer, the sole plate is again heated in the oven to 400° C. and then placed for a few seconds under infrared radiation at a temperature of between 400° C. and 600° C.

An aqueous palladium nitrate solution stabilized with nitric acid, sole by Metalor, is sprayed over the sole plate using an air gun. A layer with a thickness of approximately 40 to 50 nm, measured according to the RBS method described above, is then deposited.

After application of this external layer, the assembly is rebaked under infrared radiation at 500° C. for three minutes.

An iron sole plate is obtained, the self-cleaning coating of which adheres to the sole plate and has a catalytic activity, while retaining its gliding qualities.

This iron sole plate corresponds to that illustrated in FIG. 2, which is that of an iron sole plate according to the invention with a bilayer self-cleaning coating on an enameled support. The only difference (which does not appear in this figure) is related to the nature of the oxidation catalyst of the internal layer of the self-cleaning coating, which is a cupper oxide in this example and not a rare earth metal oxide, as is the case according to the present invention.

The results in terms of catalytic activity are given and commented on in table 1 and example 4.

The results in terms of abrasion resistance are given in table 2 and example 5.

Example 1

1st Example of $PdO/CeO_2$ Bilayer Coating According to the Invention on an Enameled Support A clean iron sole plate made of enameled aluminum is placed on a thick support made of aluminum acting as heat reservoir in order to limit, as far as possible, the variations in temperature.

The assembly is heated in an oven to a temperature of 300° C. The sole plate, with the support, is placed under infrared radiation for a few seconds until a surface temperature of between 300° C. and 350° C. is achieved.

Cerium nitrate is dissolved in water. This cerium nitrate solution is subsequently sprayed over the sole plate using an air gun. A layer with a thickness of approximately 50 nm to 100 nm, measured according to the RBS method, is then deposited.

After the application of this internal layer, the sole plate is heated in the oven to 250° C. and then placed under infrared radiation at a temperature of between 280° C. and 350° C. for a few seconds.

An aqueous palladium nitrate solution stabilized with nitric acid is sprayed over the sole plate using an air gun. A layer with a thickness of approximately 15 to 50 nm, measured according to the RBS method described above, is then deposited.

After application of this external layer, the assembly is rebaked under infrared radiation at a temperature of 480° C. for 4 minutes.

An iron sole plate is obtained, the self-cleaning coating of which adheres particularly well to the sole plate and has a very good catalytic activity, while retaining its gliding qualities.

This iron sole plate is illustrated in FIG. 2.

The results in terms of catalytic activity are given and commented on in table 1 and example 4.

The results in terms of abrasion resistance are given in table 2 and example 5.

Example 2

2nd Example of $PdO/Y_2O_3$ Bilayer Coating According to the Invention on an Enameled Support A clean iron sole plate made of enameled aluminum is placed on a thick support made of aluminum acting as heat reservoir in order to limit, as far as possible, the variations in temperature. The assembly is heated in an oven to a temperature of 300° C. The sole plate, with the support, is placed under infrared radiation for a few seconds until a surface temperature of between 300° C. and 350° C. is achieved.

Yttrium nitrate is dissolved in water. This yttrium nitrate solution is subsequently sprayed over the sole plate using an air gun. A layer with a thickness of approximately 50 nm to 100 nm, measured according to the RBS method, is then deposited.

After the application of this internal layer, the sole plate is heated in the oven to 250° C. and then placed under infrared radiation at a temperature of between 280° C. and 350° C. for a few seconds.

An aqueous palladium nitrate solution stabilized with nitric acid is sprayed over the sole plate using an air gun. A layer with a thickness of approximately 15 to 50 nm, measured according to the RBS method described above, is then deposited.

After application of this external layer, the assembly is rebaked under infrared radiation at a temperature of 500° C. for 4 minutes.

An iron sole plate is obtained, the self-cleaning coating of which adheres particularly well to the sole plate and has a very good catalytic activity, while retaining its gliding qualities.

This iron sole plate is also illustrated in FIG. 2.

The results in terms of catalytic activity are given and commented on in table 1 and example 4.

The results in terms of abrasion resistance are given in table 2 and example 5.

Example 3

Example of a Monolayer Coating ($PdO+Y_2O_3$) According to the Invention on an Enameled Support A clean iron sole plate made of an enameled aluminum is placed on a thick support made of aluminum acting as heat reservoir in order to limit, as far as possible, the variations in temperature.

The assembly is heated in an oven to a temperature of 250° C. The sole plate, with the support, is placed under infrared radiation for a few seconds until a surface temperature of between 280° C. and 350° C. is achieved.

An aqueous palladium nitrate solution stabilized by nitric acid, to which yttrium nitrate is added as dopant, is sprayed over the sole plate using an air gun. A layer with a thickness of approximately 50 to 100 nm, measured according to the RBS method described above, is then deposited.

After application of this external layer, the assembly is rebaked under infrared radiation at a temperature of 500° C. for 4 minutes.

An iron sole plate is obtained, the self-cleaning coating of which adheres particularly well to the sole plate and has a very good catalytic activity, while retaining its gliding qualities.

This iron sole plate is also illustrated in FIG. 4.

The results in terms of catalytic activity are given and commented on in table 1 and example 4.

The results in terms of abrasion resistance are given in table 2 and example 5.

Example 4

Determination of the Catalytic Activity

The catalytic activity of the self-cleaning coating was determined, according to the method described above, for each of the coatings of comparative examples 1 to 3 and examples 1 to 3.

The results, which are presented in table 1 below, are comparative results.

They are given with respect to the catalytic activity of the self-cleaning coating of comparative example 1, to which the index 100 is assigned.

The results in terms of catalytic activity which are presented in table 1 show that:

when a dopant, such as yttrium oxide $Y_2O_3$, is used in a monolayer deposit (example 3), the amount of palladium oxide can be divided by four in order to obtain a catalytic activity equivalent to that which would be obtained with a monolayer PdO deposit on an enameled support (comparative example 1);

when a dopant, such as yttrium oxide $Y_2O_3$, is used in a bilayer deposit (example 2), the amount of palladium oxide can also be divided by four in order to obtain a catalytic activity which is slightly better (index 100) than that which would be obtained with a PdO on Ago bilayer deposit on an enameled support (index 95 for comparative example 2);

with the same amount of palladium oxide as in the coating of comparative example 1 and also using, as dopant, yttrium oxide $Y_2O_3$, the catalytic activity (examples 2 and 3) is from 1.3 to 1.4 times (according to whether a monolayer or bilayer is respectively present) greater than that of the coating of comparative example 1, finally, still with the same amount of palladium oxide as in the coating of FR 2 848 290 (example 1) but this time using cerium oxide $CeO_2$ as dopant, the catalytic activity (examples 2 and 3) is 3 times greater than that of the coating of comparative example 1.

The results, which are presented in table 2 below, are comparative results.

They are given in the form of a grade between 0 and 1, assigned on conclusion of the test, after:

observation of the wear of the abraded region using a stereoscopic microscope and under appropriate lighting, then comparison with the grading scale represented in FIGS. 5 to 8.

The results in terms of abrasion resistance presented in table 2 show that:

the abrasion resistance is judged to be excellent for a bilayer $PdO/CeO_2$ coating on an enameled support according to the invention, whatever the amount of palladium oxide;

the abrasion resistance is judged to be excellent for a monolayer or bilayer coating on an enameled support according to the invention doped by yttrium oxide $Y_2O_3$ and with an amount of palladium oxide divided by four with respect to that of comparative example 1 (dopant-free PdO monolayer);

the abrasion resistance is judged to be very satisfactory for a monolayer or bilayer coating on an enameled support according to the invention doped by yttrium oxide $Y_2O_3$ with an amount of palladium oxide which is equal or divided by two with respect to that of comparative example 1 (dopant-free PdO monolayer).

TABLE 1

Comparison of the catalytic activity of the coatings of comparative examples 1 to 3 and examples 1 to 3

| | Catalytic activity on enameled aluminum | | | | | |
|---|---|---|---|---|---|---|
| Amount of PdO | Comparative example 1 Monolayer PdO coating on an enameled support | Comparative example 2 Bilayer PdO/Ago coating on an enameled support according to FR 2 848 290 | Comparative example 3 Bilayer PdO/Cuo coating on an enameled support according to FR 2 848 290 | Example 1 Bilayer $PdO/CeO_2$ coating on an enameled support according to the invention | Example 2 Bilayer $PdO/Y_2O_3$ coating on an enameled support according to the invention | Example 3 Monolayer $PdO + Y_2O_3$ coating on an enameled support according to the invention |
| 1 | 100 Reference value | ~95 | 30 | 300 | ~140 | ~130 |
| ½ | 75 | ~70 | 9 | 190 | 115 | 115 |
| ¼ | 65 | 60 | ND | 140 | 100 | 100 |

Key:
ND: Not determined
~: approximately

Example 5

Determination of the Abrasion Resistance

The abrasion resistance of the self-cleaning coating was determined, according to the test described above in accordance with the standard EN ISO 12947-1, for each of the coatings of comparative examples 1 to 3 and examples 1 to 3.

TABLE 2

Comparison of the abrasion resistance of the coatings of comparative examples 1 to 3 and examples 1 to 3

| | Abrasion resistance of the coatings on enameled aluminum | | | | | |
|---|---|---|---|---|---|---|
| Amount of PdO | Comparative example 1 Monolayer PdO coating on an enameled support | Comparative example 2 Bilayer PdO/Ago coating on an enameled support according to FR 2 848 290 | Comparative example 3 Bilayer PdO/Cuo coating on an enameled support according to FR 2 848 290 | Example 1 Bilayer $PdO/CeO_2$ coating on an enameled support according to the invention | Example 2 Bilayer $PdO + Y_2O_3$ coating on an enameled support according to the invention | Example 3 Monolayer $PdO/Y_2O_3$ coating on an enameled support according to the invention |
| 1 | >0.75 | 0.25 to 0.5 | 0.25 to 0.5 | 0 | 0.25 | 0.25 |
| ½ | 0.75 | 0.25 | 0 to 0.25 | 0 | 0.25 | 0.25 |
| ¼ | 0.5 | 0.25 | ND | 0 | 0 | 0 |

Key:
ND: Not determined

The invention claimed is:

1. A heating appliance comprising a metal support, at least a portion of which is covered with a self-cleaning coating in contact with the ambient air, said coating comprising at least one oxidation catalyst chosen from platinum group metal oxides and at least one dopant for said oxidation catalyst chosen from rare earth metal oxides, wherein said self-cleaning coating is a bilayer coating comprising:

an internal layer at least partially covering the metal support and comprising said dopant, and an external layer in contact with the ambient air and comprising said oxidation catalyst.

2. The appliance as claimed in claim 1, wherein the dopant is chosen from cerium oxides, yttrium oxides and their mixtures.

3. The appliance as claimed in claim 1, wherein the oxidation catalyst is chosen from palladium oxides, platinum oxides and their mixtures.

4. The appliance as claimed in claim 1, wherein said self-cleaning coating is a bilayer coating which is composed of an internal layer of cerium oxide or yttrium oxide and of an external layer of palladium oxide.

5. The appliance as claimed in claim 1, wherein the thickness of the external layer, measured according to the RBS method, is between 10 nm and 500 nm and preferably between 15 nm and 60 nm.

6. The appliance as claimed in claim 1, wherein the thickness of the internal layer, measured according to the RBS method, is between 30 nm and 60 nm.

7. The appliance as claimed in claim 1, wherein it additionally comprises an intermediate protective layer located between the metal support and the internal layer of the self-cleaning coating, said intermediate protective layer being composed of a material chosen from aluminum alloys, enamel and their mixtures, so as to form a support which is catalytically inert as regards the oxidation.

8. The appliance as claimed in claim 7, wherein said intermediate protective layer is made of enamel.

9. The appliance as claimed in claim 1, wherein it is provided in the form of an iron sole plate comprising an ironing surface and in that the self-cleaning coating covers the ironing surface.

10. The appliance as claimed in claim 1, wherein it is provided in the form of a cooking appliance comprising walls capable of coming into contact with contaminants of organic origin, said self-cleaning coating covering these walls.

11. A process for producing a heating appliance comprising a metal support, at least a portion of which is covered with a self-cleaning coating, comprising the following stages:

i. the surface of the metal support to be covered is heated to a temperature of 300° C. and 400° C. in an oven or under infrared radiation;

ii. a solution of an oxidation catalyst precursor is sprayed over the surface of the metal support to be covered, said oxidation catalyst precursor being chosen from platinum group metal salts, in order to obtain a self-cleaning coating layer, iii. the surface of the metal support covered with the self-cleaning coating layer is baked in an oven or under infrared radiation for a few minutes, wherein the process additionally comprises the doping of said self-cleaning coating layer by a dopant chosen from rare earth metal oxides.

12. The process as claimed in claim 11, wherein the doping and the fixing of said self-cleaning coating layer are carried out during stage ii by addition, to the solution of oxidation catalyst precursor, of a dopant precursor chosen from rare earth metal salts, so as to form a monolayer self-cleaning coating.

13. The process as claimed in claim 11, wherein the doping and the fixing of said self-cleaning coating layer are carried out between stages i and ii as follows:

i.1 a solution of a dopant precursor chosen from rare earth metal salts is sprayed over the surface of the metal support to be covered, in order to form an internal coating layer, i.2 the surface of the metal support is again heated to a temperature of between 250° C. and 400° C. in an oven in the infrared radiation sense.

14. The process as claimed in claim 11, wherein the dopant salts or oxidation catalyst salts are acetates, chlorides or nitrates.

* * * * *

UNITED STATES PATENT AND TRADEMARK OFFICE

CERTIFICATE OF CORRECTION

PATENT NO. : 8,745,904 B2
APPLICATION NO. : 13/989924
DATED : June 10, 2014
INVENTOR(S) : Denis Paccaud It is certified that error appears in the above-identified patent and that said Letters Patent is hereby corrected as shown below:

In the Claims

Column 16, Line 36, Claim 13, delete "is" and insert -- covered with the internal layer is --

Signed and Sealed this
Thirtieth Day of September, 2014

Michelle K. Lee

Michelle K. Lee
*Deputy Director of the United States Patent and Trademark Office*